US008969767B2

(12) United States Patent
Beer

(10) Patent No.: US 8,969,767 B2
(45) Date of Patent: Mar. 3, 2015

(54) MICROWAVE HEATING OF AQUEOUS SAMPLES ON A MICRO-OPTICAL-ELECTRO-MECHANICAL SYSTEM

(75) Inventor: Neil Reginald Beer, Pleasanton, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 1591 days.

(21) Appl. No.: 12/326,594

(22) Filed: Dec. 2, 2008

(65) Prior Publication Data

US 2009/0236330 A1 Sep. 24, 2009

Related U.S. Application Data

(60) Provisional application No. 61/038,552, filed on Mar. 21, 2008.

(51) Int. Cl.
*H05B 6/64* (2006.01)
*H05B 6/80* (2006.01)

(52) U.S. Cl.
CPC ..... *H05B 6/802* (2013.01)
USPC ..... 219/680; 219/687

(58) Field of Classification Search
CPC ..... H05B 6/802; H05B 6/804; H05B 6/108; H05B 6/62; H05B 6/80; H05B 6/705; H05B 6/72; H05B 6/78; H05B 7/185; A47J 31/547; C02F 1/325; C12Q 1/686; C12M 27/02; F25D 31/005; B01J 19/30; F28D 15/00; F28F 13/187; H01L 23/3672
USPC ..... 219/680, 383, 690, 691, 692, 693, 687, 219/688, 689, 628, 772; 250/432 R; 435/91.2, 289.1; 165/61, 104.15, 165/104.19, 133, 185
See application file for complete search history.

(56) References Cited

U.S. PATENT DOCUMENTS 6,605,454 B2 * 8/2003 Barenburg et al. ..... 435/173.7
7,013,739 B2 * 3/2006 Schroeder et al. ..... 73/861
2005/0221339 A1 * 10/2005 Griffiths et al. ..... 435/6

(Continued)

OTHER PUBLICATIONS

Jayna J Shah, "Microwave dielectric heating of fluids in an integrated microfluidic device", Published Oct. 3, 2007, Journal of Micromechanics and Microengineering, (2007) 2224-2230.*

(Continued)

*Primary Examiner* — Henry Yuen
*Assistant Examiner* — Hemant Mathew
(74) *Attorney, Agent, or Firm* — Eddie E. Scott

(57) ABSTRACT

Apparatus for heating a sample includes a microchip; a microchannel flow channel in the microchip, the microchannel flow channel containing the sample; a microwave source that directs microwaves onto the sample for heating the sample; a wall section of the microchannel flow channel that receives the microwaves and enables the microwaves to pass through wall section of the microchannel flow channel, the wall section the microchannel flow channel being made of a material that is not appreciably heated by the microwaves; a carrier fluid within the microchannel flow channel for moving the sample in the microchannel flow channel, the carrier fluid being made of a material that is not appreciably heated by the microwaves; wherein the microwaves pass through wall section of the microchannel flow channel and heat the sample.

4 Claims, 3 Drawing Sheets

(56) References Cited

U.S. PATENT DOCUMENTS

| | | | | |
|---|---|---|---|---|
| 2006/0005634 | A1* | 1/2006 | Schroeder et al. | 73/861 |
| 2008/0166793 | A1* | 7/2008 | Beer et al. | 435/287.2 |
| 2008/0176289 | A1* | 7/2008 | Zeng et al. | 435/91.2 |

OTHER PUBLICATIONS

Christian Fermer, et al, "Microwave-assisted high-speed PCR", Europeon Journal of Pharmaceutical Sciences 18 (2003) 129-132.

R. Pelster, Bounds for local and average microwave absorption in heterogeneous systems, Journal of Colloid and Interface Science 318 (2008) 534-540.

Jayna J. Shah, et al, "Microwave dielectric heating of fluids in an intergrated microfluidic device", Journal of Micromechanics and Microengineering, 17 (2007) 2224-2230.

Christian Holtze, "The microwave absorption of emulsions containing aqueous micro- and nanodroplets: A means to optimize microwave heating", Journal of Colloid and Interfaces Science 302 (2006) 651-657.

* cited by examiner

MICROWAVE HEATING OF AQUEOUS SAMPLES ON A MICRO-OPTICAL-ELECTRO-MECHANICAL SYSTEM

CROSS-REFERENCE TO RELATED APPLICATIONS

The present application claims benefit under 35 U.S.C. §119(e) of U.S. Provisional Patent Application No. 61/038,552 filed on Mar. 21, 2008 entitled "method instantaneous in-line heating of aqueous samples on a micro-optical-electro-mechanical system (MOEMS) device," the disclosure of which is hereby incorporated by reference in its entirety for all purposes.

STATEMENT AS TO RIGHTS TO INVENTIONS MADE UNDER FEDERALLY SPONSORED RESEARCH AND DEVELOPMENT

The United States Government has rights in this invention persuant to Contract No. DE-AC52-07NA27344 between the United States Department of Energy and Lawrence Livermore National Security, LLC for the operation of Lawrence Livermore National Laboratory.

BACKGROUND OF THE INVENTION

1. Field of Endeavor

The present invention relates to thermal cycling and more particularly to instantaneous in-line heating of aqueous samples on a micro-optical-electro-mechanical system (MOEMS).

2. State of Technology

Microfluidic devices are revolutionizing environmental, chemical, biological, medical, and pharmaceutical detectors and diagnostics. "Microfluidic devices" loosely describes the new generation of instruments that mixes, reacts, fractionates, detects, and characterizes complex samples in a micro-electro-mechanical system (MEMS) circuits manufactured through standard semiconductor lithography techniques. These techniques allow mass production at low cost as compared to previous benchtop hardware. The applications for MEMS devices are numerous, and as diverse as they are complex. Typically these devices employ aqueous solvents as the chemical reaction medium, which may or may not be partitioned into discrete segments either as "slugs" spanning the entire channel or discrete droplets emulsified in an oil flow.

As sample volumes decrease, reagent costs plummet, reactions proceed faster and more efficiently, and device customization is more easily realized. By reducing the reactor channel dimensions, supplying the requisite activation thermal energy to drive endothermic reactions on-chip becomes much faster as heat diffusion distance decreases proportional to the channel length and the thermal mass to heat decreases on the order of length cubed. However, current MEMS fluidic systems have the problem of heating not only the chemical reactor volumes within their channels (whether they be "slugs" or emulsion droplet streams), but also heating the entire substrate which is terribly inefficient for cyclical heating reactions where the heat deposited must then be quickly removed. As the reactions proceed the substrate accumulates heat, and takes much longer to cool down.

The present invention provides a method of near-instantaneous thermal energy deposition into the aqueous chemical reactor partitions or streams utilizing microwave absorption of energy from a coincident low power Co-planar waveguide (CPW) or microwave transmission line. Microwave heating of aqueous solutions exhibits excellent energy deposition due to the polarization of the water molecules. This mechanism is exploited by the ubiquitous microwave oven, and can be adapted to microscale lab-on-chip systems by innovative design and placement of microwave cavities on MEMS devices. This method provides a major improvement over prior art microfluidic channel heating methods such as joule-heating from trace resistors sputtered or electron-beamed onto the channel walls during device fabrication. The prior art methods are time-consuming and provide the associated device heat build-up described above. This not only provides the desirable cost incentive, but can cut processing times by an order of magnitude or greater, making popular on-chip process such as Polymerase Chain Reaction (PCR), in vitro protein translation, immunoassay analysis, etc. truly real time. The benefits to bacterial, viral, chemical, explosives, and other detection, as well as point-of-care diagnostics, are obvious. Also, the burgeoning field of on-chip synthesis of chemical complexes, nanoparticles, and other novel compounds relies on precise energy deposition which is ideally suited by this method.

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides heating a sample on a microchip. The present invention provides a microchannel flow channel in a microchip. The sample is positioned within the microchannel flow channel. A microwave source directs microwaves onto the sample for heating the sample. The microchannel flow channel has a wall section that receives the microwaves and enables the microwaves to pass through wall section of the microchannel flow channel without being appreciably heated by the microwaves. A carrier fluid in the microchannel flow channel moves the sample in the microchannel flow channel. The carrier fluid is not appreciably heated by the microwaves.

In one embodiment the present invention provides an apparatus for heating a sample. The apparatus includes a microchip; a microchannel flow channel in the microchip, the microchannel flow channel containing the sample; a microwave source that directs microwaves onto the sample for heating the sample; a wall section of the microchannel flow channel that receives the microwaves and enables the microwaves to pass through wall section of the microchannel flow channel, the wall section the microchannel flow channel being made of a material that is not appreciably heated by the microwaves; a carrier fluid within the microchannel flow channel for moving the sample in the microchannel flow channel, the carrier fluid being made of a material that is not appreciably heated by the microwaves; wherein the microwaves pass through wall section of the microchannel flow channel and heat the sample.

In another embodiment the present invention provides a method of heating a sample on a microchip. The method includes the steps of providing a microchannel flow channel in the microchip; positioning the sample within the microchannel flow channel, providing a microwave source that directs microwaves onto the sample for heating the sample; providing the microchannel flow channel with a wall section that receives the microwaves and enables the microwaves to pass through wall section of the microchannel flow channel without being appreciably heated by the microwaves; and providing a carrier fluid in the microchannel flow channel that moves the sample in the microchannel flow channel wherein the carrier fluid is not appreciably heated by the microwaves.

The present invention has use in a number of applications. For example, the present invention has use in biowarfare detection applications for identifying, detecting, and monitoring bio-threat agents that contain nucleic acid signatures, such as spores, bacteria, viruses etc. The present invention also has use in biomedical applications for tracking, identifying, and monitoring outbreaks of infectious disease including emerging, previously unidentified and genetically engineered pathogens; for automated processing, amplification, and detection of host or microbial and viral DNA or RNA in biological fluids for medical purposes; for high throughput genetic screening for drug discovery and novel therapeutics; and cell cytometry or viral cytometry in fluids drawn from clinical or veterinary patients for subsequent analysis. The present invention has use in forensic applications for automated processing, amplification, and detection DNA in biological fluids for forensic purposes Food and Beverage Safety; and for automated food testing for bacterial or viral contamination; for water and milk supply sampling. The present invention has use in nanoparticle synthesis and microscale chemical processing for chemical processing and assembly of novel nano-structures, probes, and other endothermic reaction products of interest for manufacturing through microfluidic systems.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF SPECIFIC EMBODIMENTS

Figure 1:
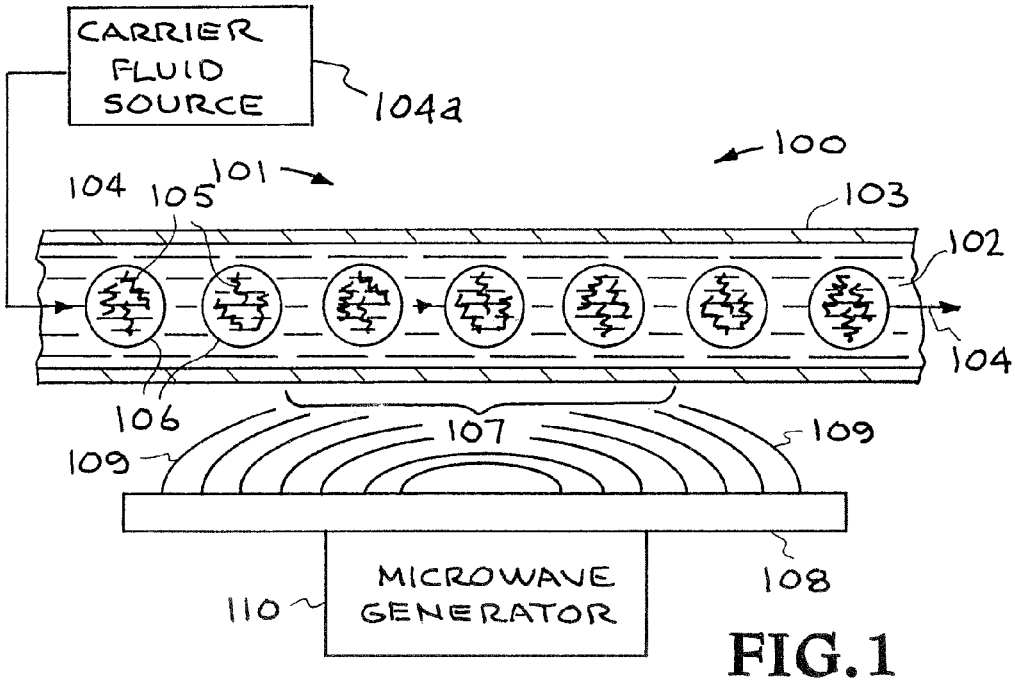
FIG. 1 illustrates one embodiment of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Referring now to the drawings and in particular to FIG. 1, one embodiment of a system constructed in accordance with the present invention is illustrated. The system is designated generally by the reference numeral 100. The system 100 provides extremely rapid and efficient heating of aqueous solutions within continuous streams or segmented microdroplets on a micro-optical-electro-mechanical system (MOEMS) device 101.

The device 101 includes a microchannel flow channel 102. The microchannel flow channel 102 is contained within silicon or glass walls 103. A carrier fluid source 104*a* introduces a carrier fluid 104 represented by the arrows into the microchannel flow channel 102. The carrier fluid 104 can be oil, Fluorinert, water, or other carrier fluid. The sample 105 to be analyzed is introduced to the microchannel flow channel 102 by a droplet maker or other device that produces droplets or microreactors 106. The sample 105 is contained within the droplets or microreactors 106 and can be bacterial cells, virus particles, nucleic acids, proteins, biomolecules, chemical agents, explosives agents, and other targets of interest. An example of a droplet maker is disclosed in the article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35. The article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35 is incorporated herein by reference.

The droplets or microreactors 106 containing the sample are carried to a heating area 107 by the carrier fluid 104. A microwave source 108 transmits microwaves 109 through the wall 103 of the microchannel flow channel 102 in the heating area 107. The microwave source 108 shown in FIG. 1 is a microwave antenna 108 that produces microwaves 109. The microwave antenna 108 is connected to microwave generator 110. The microwaves 109 from the microwave source 108 are directed to focus the microwaves 109 into the microfluidic channel 102 through the wall 103 in the heating area 107. The silicon or glass wall 103, as well as any oil-based sheathing flow, are not appreciably heated.

Referring again to FIG. 1, the operation of the system 100 will be described. Sheathing oil and emulsified droplets 106 are injected into the flow channel 102 and act as individual chemical reactors. The flow channel 102 employs a microwave source 108 that produces microwaves 109 to heat the droplets 106. This will allow the most efficient, fastest and best method for energizing chemical reactions in microfluidics, and is far superior to prior art methods such as trace (surface electrical heaters) in the device or block heaters attached to the bottom of the channel.

The system 100 utilizes microwave energy absorption to instantaneously heat fluidic partitions functioning as chemical reactors 106 in a microfluidic device 101. The advantage of this system 100 is that the device 101 itself is not heated by the electromagnetic radiation source 108. The frequency band of the microwaves 109 is large—roughly 0.3 to 300 GHz. In the middle of this spectrum, 18 to 26 GHz has been shown to be ideal for absorption at MEMS length scales, but "millimeter wave" radiation~100 GHz) will also couple energy well, as the wavelength more closely approaches the MEMS cavity dimensions.

With the system 100 little energy is wasted heating the device 101 and instead is absorbed heating the sample 105 within the microchannel flow channel 102. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets 106 as soon as the radiation is cycled off. Thus a chilled oil stream with interspersed droplets can be a highly efficient thermal cycler, operating at speeds orders of magnitude better than what is capable today.

The microwave power absorbed per unit volume is $P_v=\sigma E^2$, where E is the electric field and $\sigma=2\pi f\in_0\in''$, f is the frequency in Hz, $\in_0$ is the permittivity of free space, and $\in''$ is the complex part of the permittivity of the material. ($\in''_{aq}>>\in''_{oil}$). Looking at the energy required to individually heat 50 μm droplets over the temperature range of use in PCR (assuming ⅓ of a second is sufficiently fast):

$$m = \rho V_{droplet} = \rho\frac{4}{3}\pi r^3 \cong 6.53\cdot 10^{-11}\ \text{kg}$$

$$\dot{Q} = mC_p\frac{dT}{dt} = 6.53\cdot 10^{-11}\cdot 4{,}186\frac{(95-30)}{0.33} = 53.8\ \mu\text{W}$$

The absorbed power required to heat droplets 106 in this size range from 30° C. to 95° C. in a third of a second is only 53.8 pW. This implies that a milliwatt-capable microwave source can easily heat an entire channel of droplets if the channel acts as a cavity or waveguide, focusing the energy to resonate in the channel (and the contained droplets). Increasing applied power will only decrease the time required. Droplet heating can be instantaneous, such that continuous flow operation (droplet generation at an upstream T-junction, for example) can be maintained.

Additionally, the system allows for optical addressability of the cavity or waveguide, which allows fluorescence detection of temperature, pH, nucleic acid amplification (for PCR), or direct optical observation of cell lysis, sedimentation, and other signals and observations under test for the real-time microfluidic device.

Figure 2:
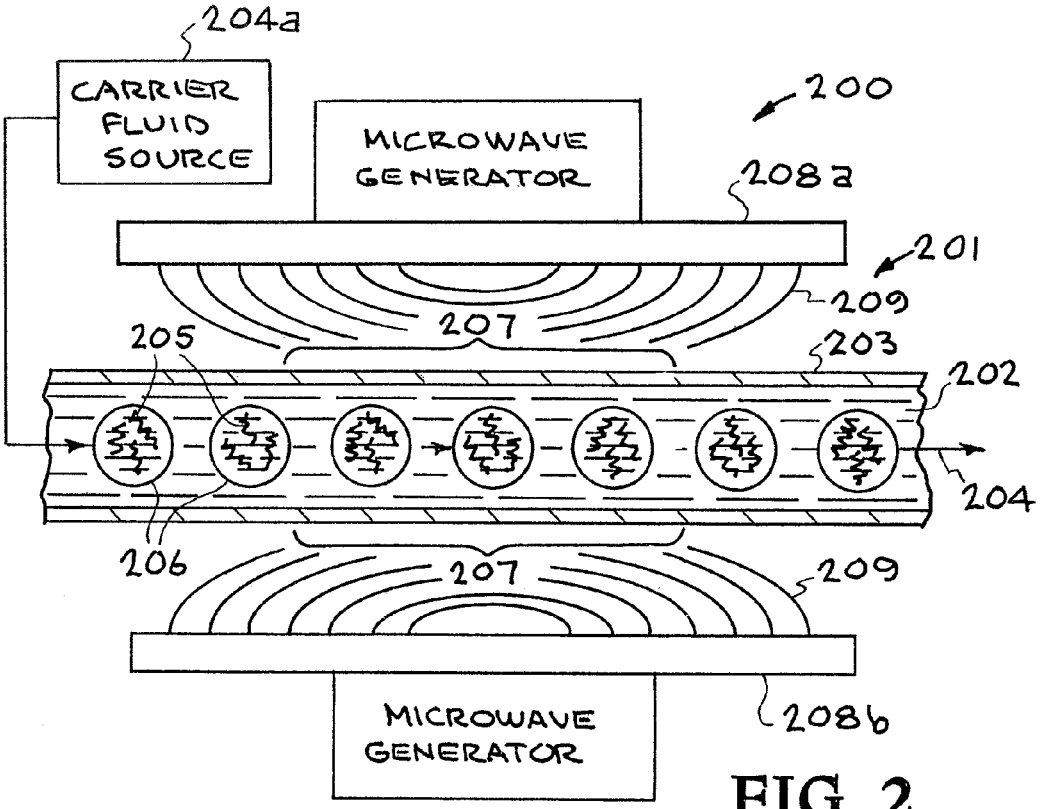
FIG. 2 illustrates another embodiment of the present invention.

Referring now to FIG. 2, another embodiment of a system constructed in accordance with the present invention is illustrated. The system is designated generally by the reference numeral 200. The system 200 provides extremely rapid and efficient heating of aqueous solutions within continuous streams or segmented microdroplets on a micro-optical-electro-mechanical system (MOEMS) device 201.

The device 201 includes a microchannel flow channel 202. The microchannel flow channel 202 is contained within silicon or glass walls 203. A carrier fluid source 204*a* introduces a carrier fluid 204 represented by the arrows into the microchannel flow channel 202. The carrier fluid 204 can be oil, Fluorinert, water, or other carrier fluid. The sample 205 to be analyzed is introduced to the microchannel flow channel 202 by a droplet maker or other device that produces droplets or microreactors 206. The sample 205 is contained within the droplets or microreactors 206 and can be bacterial cells, virus particles, nucleic acids, proteins, biomolecules, chemical agents, explosives agents, and other targets of interest. An example of a droplet maker is disclosed in the article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35. The article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35 is incorporated herein by reference.

The droplets or microreactors 206 containing the sample are carried to a heating area 207 by the carrier fluid 204. A microwave source 208*a* and 208*b* transmits microwaves 209 through the wall 203 of the microchannel flow channel 202 in the heating area 207. The microwave source 208*a* and 208*b* shown in FIG. 2 is an upper microwave antenna 208*a* and a lower microwave antenna 208*b*. The microwaves 209 from the microwave source 208 are directed to focus the microwaves 209 into the microfluidic channel 202 through the wall 203 in the heating area 207. The silicon or glass wall 203, as well as any oil-based sheathing flow, are not appreciably heated.

Referring again to FIG. 2, the operation of the system 200 will be described. Sheathing oil and emulsified droplets 206 are injected into the flow channel 202 and act as individual chemical reactors. The flow channel 202 employs a microwave source 208 that produces microwaves 209 to heat the droplets 206. The system 200 utilizes microwave energy absorption to instantaneously heat fluidic partitions functioning as chemical reactors 206 in a microfluidic device 201. The advantage of this system 200 is that the device 201 itself is not heated by the electromagnetic radiation source 208. The frequency band of the microwaves 209 is large—roughly 0.3 to 300 GHz. In the middle of this spectrum, 18 to 26 GHz has been shown to be ideal for absorption at MEMS length scales, but "millimeter wave" radiation (~100 GHz) will also couple energy well, as the wavelength more closely approaches the MEMS cavity dimensions.

With the system 200 little energy is wasted heating the device 201 and instead is absorbed heating the sample 205 within the microchannel flow channel 202. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets 206 as soon as the radiation is cycled off. Thus a chilled oil stream with interspersed droplets can be a highly efficient thermal cycler, operating at speeds orders of magnitude better than what is capable today.

Additionally, the system allows for optical addressability of the cavity or waveguide, which allows fluorescence detection of temperature, pH, nucleic acid amplification (for PCR), or direct optical observation of cell lysis, sedimentation, and other signals and observations under test for the real-time microfluidic device.

Figure 3:
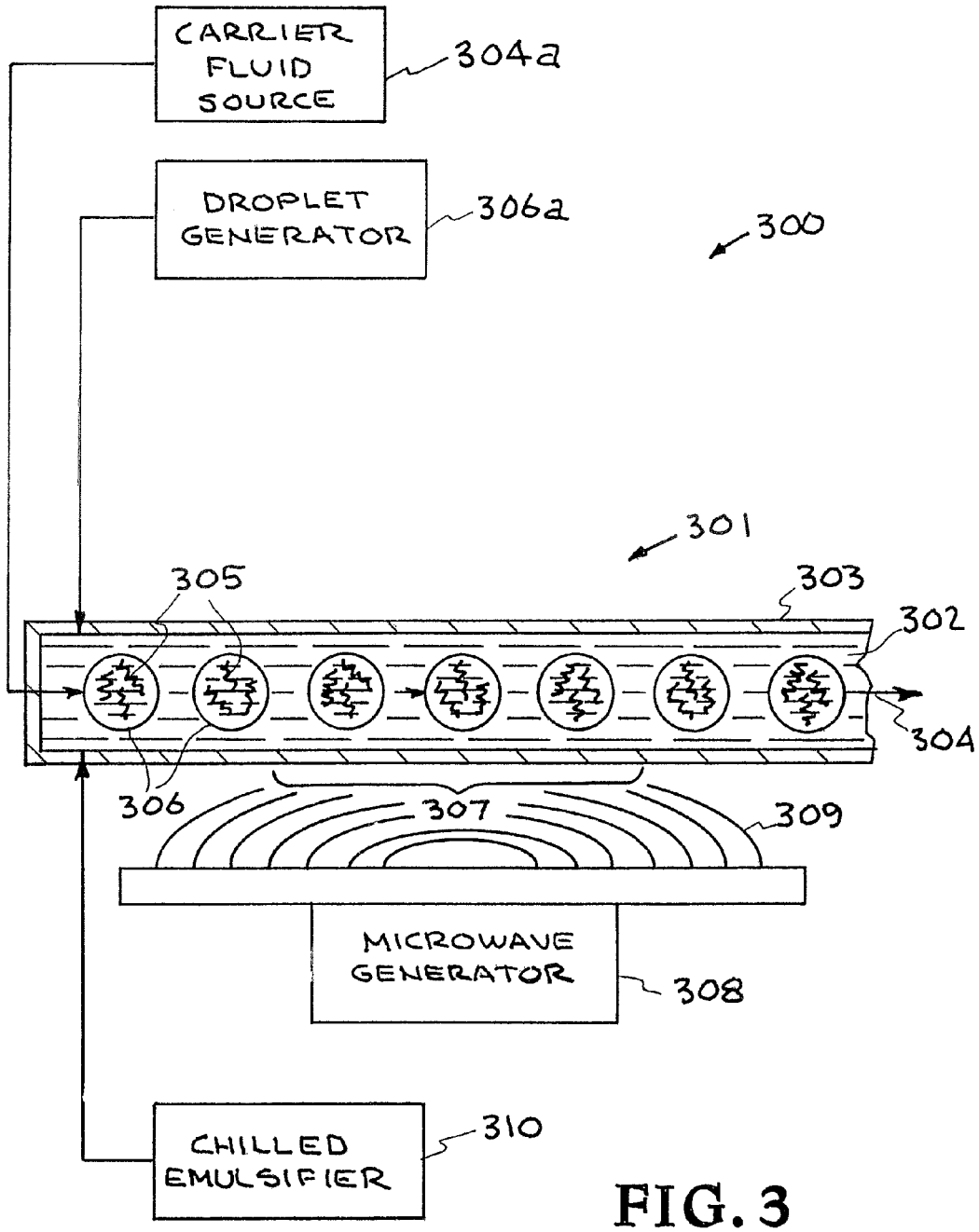
FIG. 3 illustrates yet another embodiment of the present invention.

Referring now to FIG. 3, another embodiment of a system constructed in accordance with the present invention is illustrated. The system is designated generally by the reference numeral 300. The system 300 provides extremely rapid and efficient heating of aqueous solutions within continuous streams or segmented microdroplets on a micro-optical-electro-mechanical system (MOEMS) device 301.

The device 301 includes a microchannel flow channel 302. The microchannel flow channel 302 is contained within silicon or glass walls 303. A carrier fluid source 304*a* introduces a carrier fluid 304 represented by the arrows into the microchannel flow channel 302. The carrier fluid 304 can be oil, Fluorinert, water, or other carrier fluid. The sample 305 to be analyzed is introduced to the microchannel flow channel 302 by a droplet maker 306*a* or other device that produces droplets or microreactors 306, The sample 305 is contained within the droplets or microreactors 306 and can be bacterial cells, virus particles, nucleic acids, proteins, biomolecules, chemical agents, explosives agents, and other targets of interest. An example of a droplet maker is disclosed in the article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35. The article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35 is incorporated herein by reference. The carrier fluid 304 can include an emulsifier introduced into the microchannel flow channel 102 by the chilled emulsifier source 310.

The droplets or microreactors 306 containing the sample are carried to a heating area 307 by the carrier fluid 304. A microwave source 308 transmits microwaves 309 through the wall 303 of the microchannel flow channel 302 in the heating area 307. The microwave source 308 shown in FIG. 3 is a microwave generator. The microwaves 309 from the microwave source 308 are directed to focus the microwaves 309 into the microfluidic channel 302 through the wall 303 in the heating area 307. The silicon or glass wall 303, as well as any oil-based sheathing flow, are not appreciably heated.

Referring again to FIG. 3, the operation of the system 300 will be described. Sheathing oil and emulsified droplets 306 are injected into the flow channel 302 and act as individual chemical reactors. The flow channel 302 employs a microwave source 308 that produces microwaves 309 to heat the droplets 306. The system 300 utilizes microwave energy absorption to instantaneously heat fluidic partitions functioning as chemical reactors 306 in a microfluidic device 301. The advantage of this system 300 is that the device 301 itself is not heated by the electromagnetic radiation source 308. The frequency band of the microwaves 309 is large—roughly 0.3 to 300 GHz. In the middle of this spectrum, 18 to 26 GHz has been shown to be ideal for absorption at MEMS length scales, but "millimeter wave" radiation (~100 GHz) will also couple energy well, as the wavelength more closely approaches the MEMS cavity dimensions.

With the system 300 little energy is wasted heating the device 301 and instead is absorbed heating the sample 305 within the microchannel flow channel 302. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets 306 as soon as the radiation is cycled off. Thus a chilled oil stream with interspersed droplets can be a highly efficient thermal cycler, operating at speeds orders of magnitude better than what is capable today.

Additionally, the system allows for optical addressability of the cavity or waveguide, which allows fluorescence detection of temperature, pH, nucleic acid amplification (for PCR), or direct optical observation of cell lysis, sedimentation, and other signals and observations under test for the real-time microfluidic device.

Figure 4:
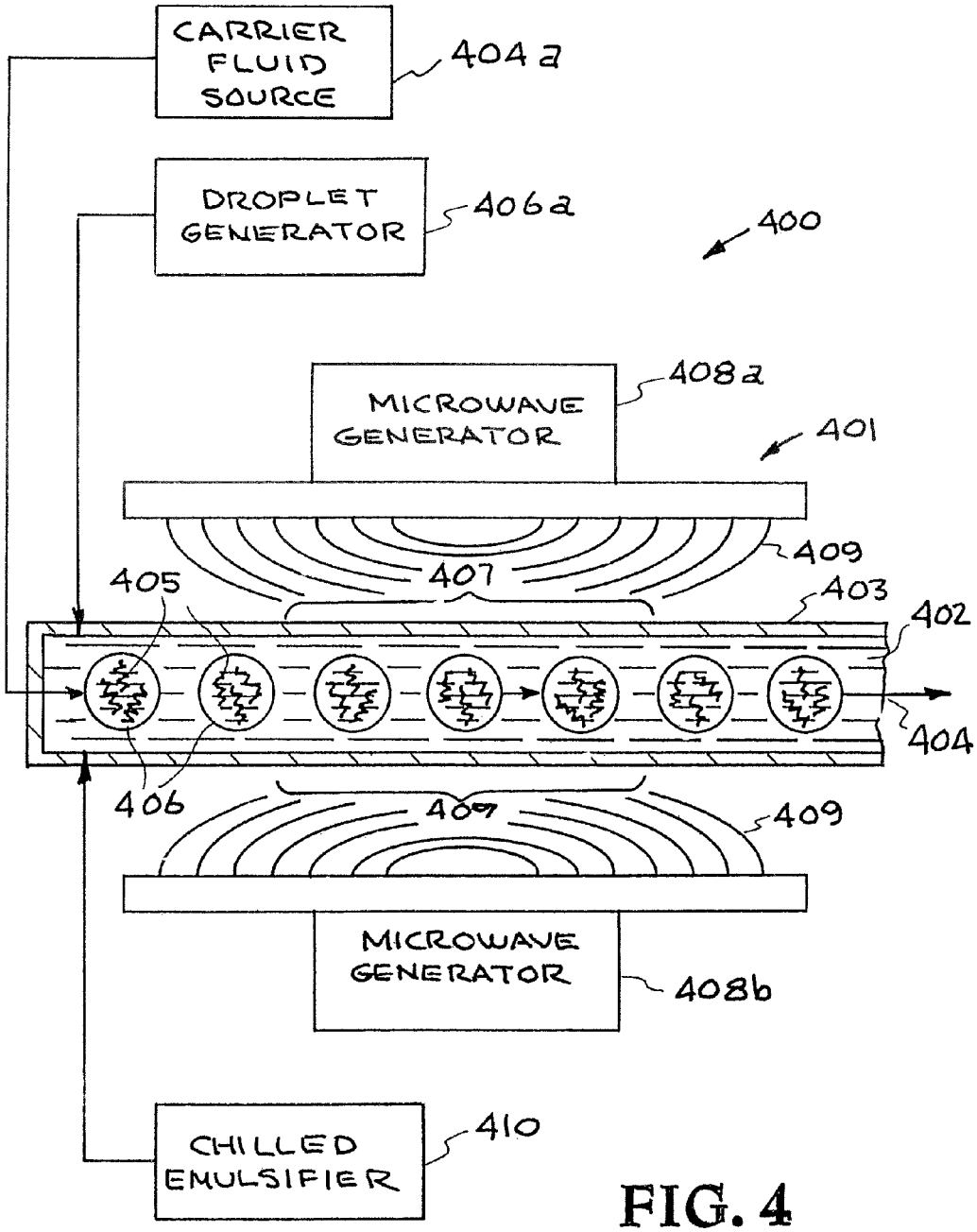
FIG. 4 illustrates another embodiment of the present invention.

Referring now to FIG. 4, another embodiment of a system constructed in accordance with the present invention is illustrated. The system is designated generally by the reference numeral 400. The system 400 provides extremely rapid and efficient heating of aqueous solutions within continuous streams or segmented microdroplets on a micro-optical-electro-mechanical system (MOEMS) device 401.

The device 401 includes a microchannel flow channel 402. The microchannel flow channel 402 is contained within silicon or glass walls 403. A carrier fluid source 404*a* introduces a carrier fluid 404 represented by the arrows into the microchannel flow channel 402. The carrier fluid 404 can be oil, Fluorinert, water, or other carrier fluid. The sample 405 to be analyzed is introduced to the microchannel flow channel 402 by a droplet maker 406*a* or other device that produces droplets or microreactors 406. The sample 405 is contained within the droplets or microreactors 406 and can be bacterial cells, virus particles, nucleic acids, proteins, biomolecules, chemical agents, explosives agents, and other targets of interest. An example of a droplet maker is disclosed in the article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35. The article, "Monodispersed microfluidic droplet generation by shear focusing microfluidic device," by Yung-Chieh Tan, Vittorio Cristini and Abraham P. Lee, in *Sensors and Actuators*, B: Chemical, Volume 114, Issue 1, 30 Mar. 2006, Pages 350-35 is incorporated herein by reference. The carrier fluid 404 can include an emulsifier introduced into the microchannel, flow channel 402 by the chilled emulsifier source 410.

The droplets or microreactors 406 containing the sample are carried to a heating area 407 by the carrier fluid 404. A microwave source 408*a* and 408*b* transmits microwaves 409 through the wall 403 of the microchannel flow channel 402 in the heating area 407. The microwave source 408*a* and 408*b* shown in FIG. 4 is an upper microwave generator 408*a* and a lower microwave generator 408*b*. The microwaves 409 from the microwave source 408 are directed to focus the microwaves 409 into the microfluidic channel 402 through the wall 403 in the heating area 407. The silicon or glass wall 403, as well as any oil-based sheathing flow, are not appreciably heated.

Referring again to FIG. 4, the operation of the system 400 will be described. Sheathing oil and emulsified droplets 406 are injected into the flow channel 402 and act as individual chemical reactors. The flow channel 402 employs a microwave source 408 that produces microwaves 409 to heat the droplets 406. The system 400 utilizes microwave energy absorption to instantaneously heat fluidic partitions functioning as chemical reactors 406 in a microfluidic device 401. The advantage of this system 400 is that the device 401 itself is not heated by the electromagnetic radiation source 408. The frequency band of the microwaves 409 is large—roughly 0.3 to 300 GHz. In the middle of this spectrum, 18 to 26 GHz has been shown to be ideal for absorption at MEMS length scales, but "millimeter wave" radiation (~100 GHz) will also couple energy well, as the wavelength more closely approaches the MEMS cavity dimensions.

With the system 400 little energy is wasted heating the device 401 and instead is absorbed heating the sample 405 within the microchannel flow channel 402. Many microfluidic devices partition the flow between the aqueous phase and either oil or air/nitrogen flows, both of these continuous phase fluids have dielectric permittivities much less than water. Therefore the carrier fluid for partitioning the chemical reactors in microfluidic devices is not effectively heated by the EM source, and subsequently can immediately cool the fluid droplets 406 as soon as the radiation is cycled off. Thus a chilled oil stream with interspersed droplets can be a highly efficient thermal cycler, operating at speeds orders of magnitude better than what is capable today.

Additionally, the system allows for optical addressability of the cavity or waveguide, which allows fluorescence detection of temperature, pH, nucleic acid amplification (for PCR), or direct optical observation of cell lysis, sedimentation, and other signals and observations under test for the real-time microfluidic device.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A micro-optical-electro-mechanical system apparatus for heating a sample, comprising:

a microchip;

a microchannel flow channel in said microchip, said microchannel flow channel including a wall section made of silicon or glass;

a chilled emulsifier carrier fluid source connected to said microchannel flow channel that introduces a chilled emulsifier carrier fluid into said microchannel flow channel, a microreactor maker connected to said microchannel flow channel that produces microreactors containing the sample and introduces said microreactors containing the sample into said microchannel flow channel and into said chilled emulsifier carrier fluid, a microwave source that directs 18 to 26 GHz microwaves onto the sample in said microreactors in said microchannel flow channel for heating the sample in said microreactors; and a heating area in said microchannel flow channel, said heating area including said wall section made of silicon or glass;

said microwave source being positioned to direct said 18 to 26 GHz microwaves to said heating area and said wall section of said microchannel flow channel so that said wall section of said microwave flow channel receives said 18 to 26 GHz microwaves and said wall section of said microwave flow channel enables said 18 to 26 GHz microwaves to pass through said wall section of said microchannel flow channel in said heating area to the sample in said microreactors, wherein said wall section of said microchannel flow channel is made of silicon or glass that does not absorb said 18 to 26 GHz microwaves and is not heated;

wherein said chilled emulsifier carrier fluid within said microchannel flow channel moves said microreactors containing the sample in said microchannel flow channel, wherein said chilled emulsifier carrier fluid does not absorb said 18 to 26 GHz microwaves and is not heated by said microwaves; wherein said 18 to 26 GHz microwaves pass through said wall section of said microchannel flow channel and heat the sample in said microreactors.

2. The micro-optical-electro-mechanical system apparatus for heating a sample of claim 1 wherein said microreactor maker that produces microreactors containing the sample is a droplet maker that produces microreactors and wherein said microreactors are droplets containing the sample and wherein said microreactor maker directs said microreactors containing the sample into said microchannel flow channel.

3. The micro-optical-electromechanical system apparatus for heating a sample of claim 1 wherein said chilled emulsifier carrier fluid source connected to said microchannel flow channel that introduces a chilled emulsifier carrier fluid into said microchannel flow channel is a chilled emulsifier carrier fluid source that includes a chilled emulsifier wherein said chilled emulsifier carrier fluid source directs said chilled emulsifier into said microchannel flow channel.

4. A method of heating a pie on a microchip, comprising the steps of:

providing a microchannel flow channel in the microchip said microchannel flow channel having a wall section made of silicon or glass and a heating area proximate said wall section;

providing a chilled emulsifier carrier fluid source connected to said microchannel flow channel that introduces a chilled emulsifier carrier fluid into said microchannel flow channel in the microchip, providing a microreactor maker connected to said microchannel flow channel that produces microreactors containing the sample and introduces said microreactors containing the sample into said microchannel flow channel thereby positioning said microreactors containing the sample within said microchannel flow channel and in said chilled emulsifier carrier fluid in said heating area proximate said wall section, heating the sample by providing a microwave source that produces 18 to 26 GHz microwaves and positioning said microwave source so that said microwave source directs said 18 to 26 GHz microwaves to said heating area proximate said wall section by directing said 18 to 26 GHz microwaves through said wall section of said microchannel flow channel onto said microreactors containing the sample for heating the sample;

wherein said microchannel flow channel with a wall section receives said 18 to 26 GHz microwaves and enables said 18 to 26 GHz microwaves to pass through said wall section of said microchannel flow channel and said wall section does not absorb said 18 to 26 GHz microwaves and wherein said said microreactors containing the sample within said microchannel flow channel receive said 18 to 26 GHz microwaves and the sample in said microreators is heated by said 18 to 26 GHz microwaves; and wherein said chilled emulsifier carrier fluid in said microchannel flow channel moves said microreactors containing the sample in said microchannel flow channel wherein said chilled emulsifier carrier fluid does not absorb said 18 to 26 GHz microwaves and is not heated by said microwaves.

* * * * *

UNITED STATES PATENT AND TRADEMARK OFFICE

CERTIFICATE OF CORRECTION

PATENT NO. : 8,969,767 B2
APPLICATION NO. : 12/326594
DATED : March 3, 2015
INVENTOR(S) : Neil Reginald Beer It is certified that error appears in the above-identified patent and that said Letters Patent is hereby corrected as shown below:

In the Claims

Column 10
Line 17, delete “pie” and insert --sample--.

Signed and Sealed this
Second Day of February, 2016

Michelle K. Lee

Michelle K. Lee
*Director of the United States Patent and Trademark Office*